US010843884B2

(12) United States Patent
Tanabe et al.

(10) Patent No.: US 10,843,884 B2
(45) Date of Patent: Nov. 24, 2020

(54) CONVEYING APPARATUS, METHOD FOR ACQUIRING INFORMATION, AND NON-TRANSITORY COMPUTER-READABLE RECORDING MEDIUM

(71) Applicants: Akiko Tanabe, Kanagawa (JP); Takuya Murata, Tokyo (JP); Norio Yamada, Chiba (JP)

(72) Inventors: Akiko Tanabe, Kanagawa (JP); Takuya Murata, Tokyo (JP); Norio Yamada, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 107 days.

(21) Appl. No.: 16/271,996

(22) Filed: Feb. 11, 2019

(65) Prior Publication Data

US 2019/0283993 A1 Sep. 19, 2019

(30) Foreign Application Priority Data

Mar. 16, 2018 (JP) ..... 2018-049385

(51) Int. Cl.
*B65H 7/06* (2006.01)
*B65H 5/06* (2006.01)

(52) U.S. Cl.
CPC ..... *B65H 7/06* (2013.01); *B65H 5/06* (2013.01); *B65H 5/062* (2013.01); *B65H 2511/528* (2013.01); *B65H 2511/529* (2013.01); *B65H 2515/30* (2013.01); *B65H 2515/70* (2013.01); *B65H 2601/255* (2013.01)

(58) Field of Classification Search
CPC ... B65H 7/02; B65H 7/20; B65H 7/06; B65H 7/14; B65H 2601/255; B65H 5/06; B65H 2511/529; B65H 2511/528; B65H 2515/70; B65H 2515/30; B65H 5/062; G03G 2215/00413
See application file for complete search history.

(56) References Cited

U.S. PATENT DOCUMENTS

| | | | | |
|---|---|---|---|---|
| 9,415,961 | B2 * | 8/2016 | Nobuta | G03G 15/70 |
| 10,429,773 | B2 * | 10/2019 | Sunohara | G03G 15/1615 |
| 2014/0219668 | A1 * | 8/2014 | Mine | G03G 15/5004 399/21 |

FOREIGN PATENT DOCUMENTS

| | | |
|---|---|---|
| JP | 2017-049513 | 3/2017 |
| JP | 2017-107143 | 6/2017 |
| JP | 2019-022252 | 2/2019 |

* cited by examiner

*Primary Examiner* — Jeremy R Severson
(74) *Attorney, Agent, or Firm* — Harness, Dickey & Pierce, P.L.C.

(57) ABSTRACT

A conveying apparatus includes a rotator, a driver, a measuring device, and circuitry. The rotator is configured to convey a medium. The driver is configured to apply a driving force to the rotator to rotate the rotator. The measuring device is configured to measure the driving force applied to the rotator by the driver. The circuitry is configured to: determine, according to the driving force measured, whether to change at least one of frequency and items of information to be acquired for prediction of a defective conveyance of the medium caused by the rotator; and acquire information of at least one of the items according to a result of determination, at a frequency according to the result of determination.

13 Claims, 16 Drawing Sheets

FIG. 7

| ITEMS OF DATA TO BE ACQUIRED | FREQUENCY | |
|---|---|---|
| | LESS THAN THRESHOLD | NOT LESS THAN THRESHOLD |
| TORQUE INFORMATION | ONCE PER 100 SHEETS | ONCE PER 50 SHEETS |
| SENSOR INFORMATION | ONCE PER 100 SHEETS | ONCE PER 50 SHEETS |
| PRINT INFORMATION | – | ONCE PER 50 SHEETS |
| NUMBER OF TIMES TORQUE REACHES OR EXCEEDS THRESHOLD | – | ONCE PER 50 SHEETS |

CONVEYING APPARATUS, METHOD FOR ACQUIRING INFORMATION, AND NON-TRANSITORY COMPUTER-READABLE RECORDING MEDIUM

CROSS-REFERENCE TO RELATED APPLICATIONS

This patent application is based on and claims priority pursuant to 35 U.S.C. § 119(a) to Japanese Patent Application No. 2018-049385, filed on Mar. 16, 2018, in the Japan Patent Office, the entire disclosure of which is hereby incorporated by reference herein.

BACKGROUND

Technical Field

Embodiments of the present disclosure generally relate to a conveying apparatus, a method for acquiring information, and a non-transitory computer-readable recording medium. In particular, the embodiments of the present disclosure relate to a conveying apparatus that conveys a medium, a method for acquiring information in the conveying apparatus, and a non-transitory computer-readable recording medium storing computer-readable program code that is configured to perform the method for acquiring information in the conveying apparatus when executed by a computer system.

Related Art

Examples of conveying apparatuses include an image forming apparatus such as a printer. Such an image forming apparatus often includes a fixing device. The fixing device includes two rotators, for example, a pressure roller and a heating belt, to fix toner onto a medium under heat and pressure. A motor rotates the pressure roller; whereas the heating belt rotates in conjunction with the pressure roller.

The image forming apparatus may further include a slip detector to detect a slip between the pressure roller and the heating belt while acquiring a relatively large amount of information for prediction of a paper jam, thereby preventing the paper jam and damage to the fixing device.

SUMMARY

In one embodiment of the present disclosure, a novel conveying apparatus includes a rotator, a driver, a measuring device, and circuitry. The rotator is configured to convey a medium. The driver is configured to apply a driving force to the rotator to rotate the rotator. The measuring device is configured to measure the driving force applied to the rotator by the driver. The circuitry is configured to: determine, according to the driving force measured, whether to change at least one of frequency and items of information to be acquired for prediction of a defective conveyance of the medium caused by the rotator; and acquire information of at least one of the items according to a result of determination, at a frequency according to the result of determination.

Also described are novel method for acquiring information in the conveying apparatus and a non-transitory computer-readable recording medium storing computer-readable program code that is configured to perform the method for acquiring information in the conveying apparatus when executed by a computer system.

BRIEF DESCRIPTION OF THE DRAWINGS

A more complete appreciation of the embodiments and many of the attendant advantages and features thereof can be readily obtained and understood from the following detailed description with reference to the accompanying drawings, wherein:

FIG. 7 is a table illustrating an example of items and frequencies changeable based on a criterion for determination;

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1A:
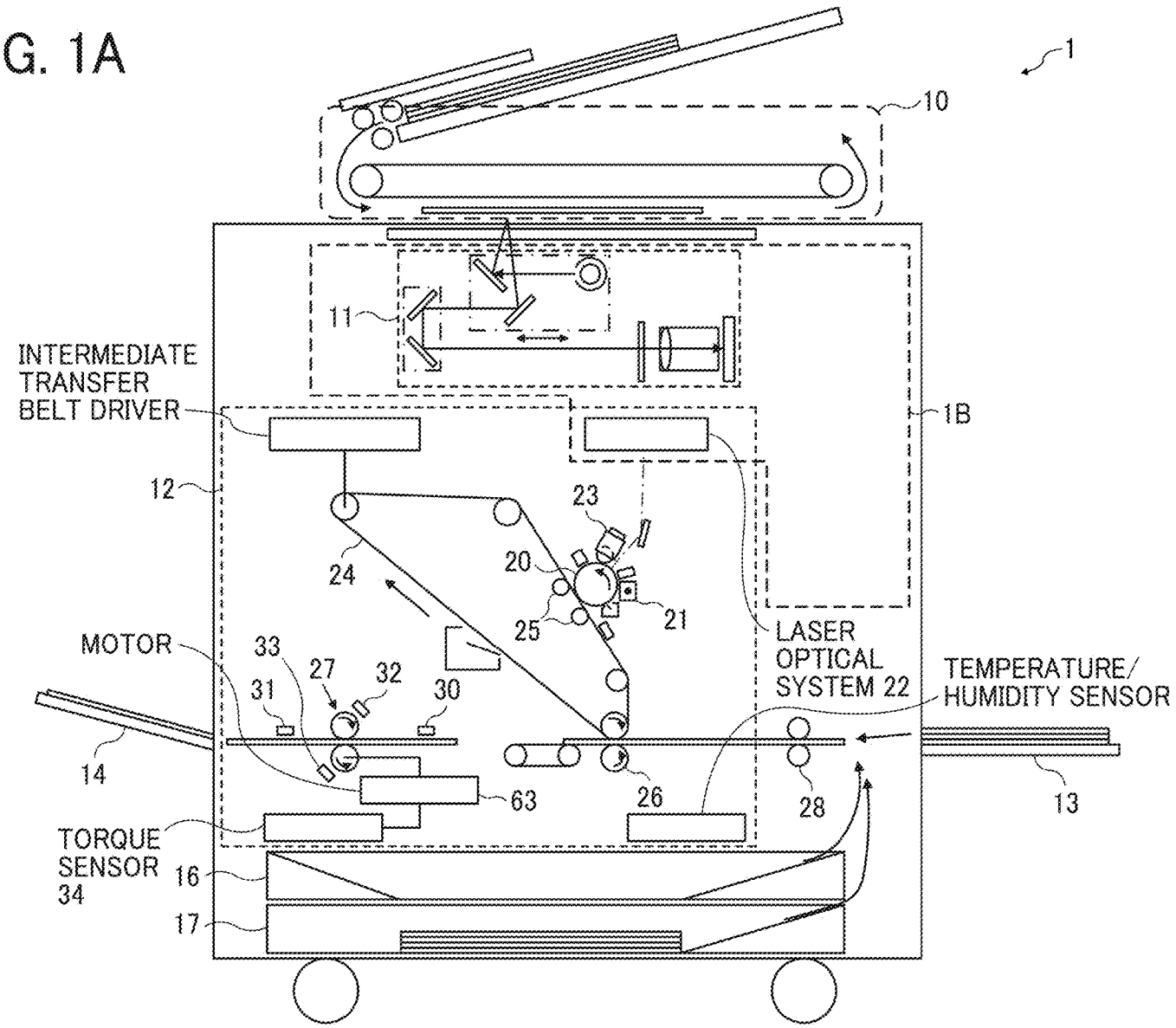
FIG. 1A is a schematic view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

Referring to the drawings, wherein like reference numerals designate identical or corresponding parts throughout the several views, embodiments of the present disclosure are described below.

Figure 1B:
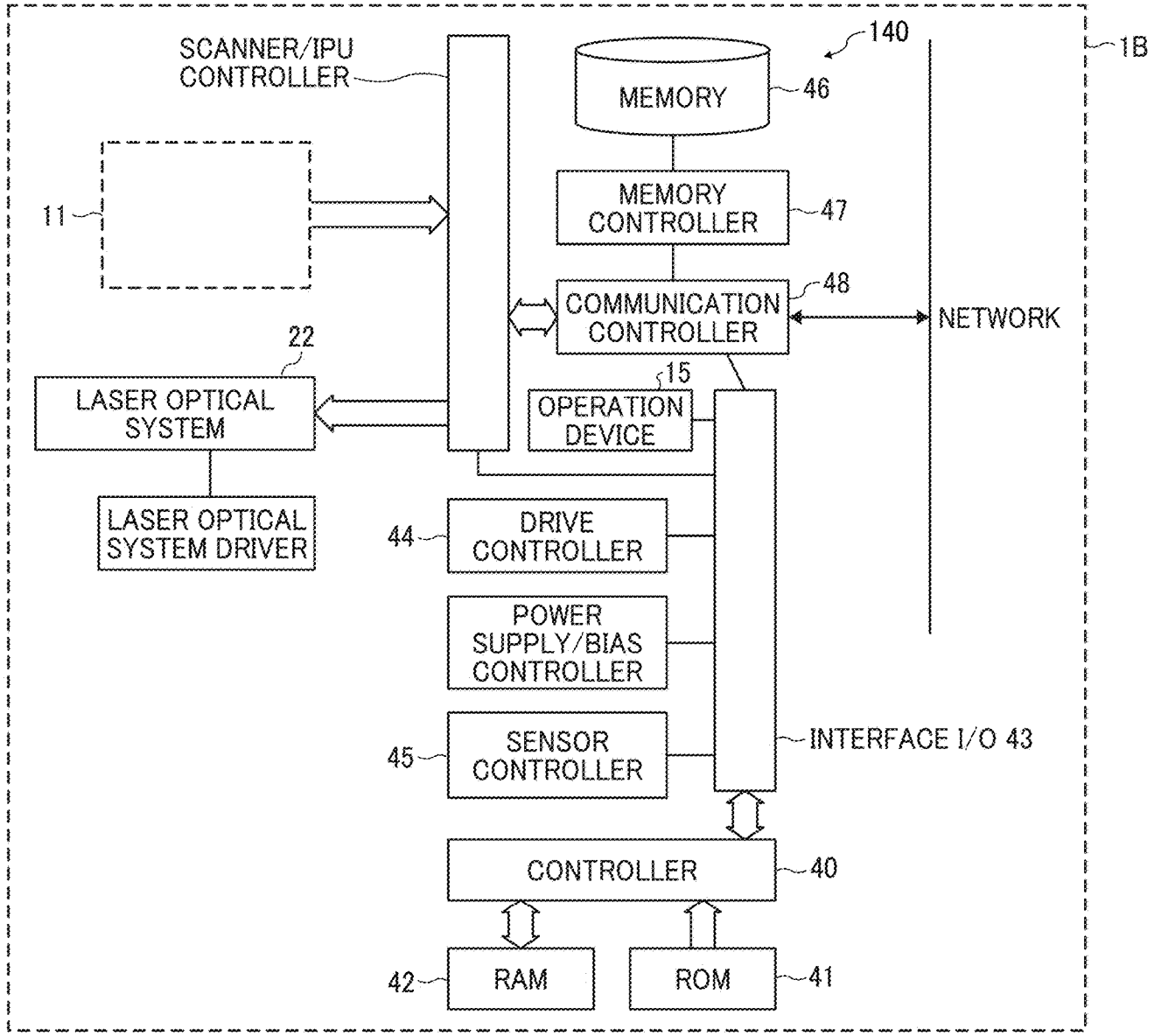
FIG. 1B is a block diagram illustrating a partial hardware configuration of the image forming apparatus.

Initially with reference to FIGS. 1A and 1B, a description is given of a hardware configuration of an image forming apparatus according to an embodiment of the present disclosure.

FIG. 1A is a schematic view of an image forming apparatus 1 serving as a conveying apparatus. FIG. 1B is a block diagram illustrating a partial hardware configuration of the image forming apparatus 1.

The image forming apparatus 1 is an example of the conveying apparatus. The conveying apparatus may be another apparatus provided that the apparatus includes rotators or a rotating device and detects a slip that occurs between the rotators or in the rotating device. The rotators may be either a large rotating machine having a large driving torque or a small rotating machine having a small driving torque. Although the image forming apparatus 1 is herein described as a conveying apparatus, the conveying apparatus is not limited to an image forming apparatus.

The image forming apparatus 1 may be any apparatus provided that the apparatus is capable of reading an image and forming the image. For example, the image forming apparatus 1 may be a printer, a copier, a facsimile machine, a scanner, or a multifunction peripheral (MFP) having at least two of, e.g., printing, copying, facsimile, and scanning functions. The image forming apparatus 1 is herein described as an MFP.

As illustrated in FIGS. 1A and 1B, the image forming apparatus 1 includes an automatic document feeder (ADF) 10, a scanner 11 serving as an image reader, an image forming device 12, an input tray 13, an output tray 14, an operation device 15, and a control device 140. The ADF 10 automatically conveys an original or a document to the scanner 11 so that the scanner 11 reads the document. The scanner 11 includes a light source and an image sensor that converts light reflected from the document into an electrical signal. With such components, the scanner 11 reads an image of the document and outputs image data.

The image forming device 12 includes a photoconductive drum 20 serving as a photoconductor, a charger 21, a laser optical system 22, a developing device 23, an intermediate transfer belt 24, a primary transfer roller 25, a secondary transfer roller 26, and a fixing device 27. FIG. 1A illustrates one photoconductive drum 20, one charger 21, and one developing device 23. In a case in which the image forming apparatus 1 is a color image forming apparatus that is capable of color printing, the photoconductive drum 20, the charger 21, and the developing device 23 may be provided by the number of colors used in color printing.

As the photoconductive drum 20 rotates in a given direction, the charger 21 charges the photoconductive drum 20. Then, the laser optical system 22 irradiates the surface of the photoconductive drum 20 with laser light, thereby forming an electrostatic latent image on the surface of the photoconductive drum 20. The developing device 23 includes a developing roller that causes toner to adhere to the surface of the photoconductive drum 20, thereby forming a toner image on the surface of the photoconductive drum 20. The primary transfer roller 25 transfers the toner image from the surface of the photoconductive drum 20 onto the intermediate transfer belt 24. Then, the secondary transfer roller 26 transfers the toner image from the intermediate transfer belt 24 onto a paper sheet, serving as a medium, conveyed by a conveyance roller pair 28 from the input tray 13. Note that sheets lie stacked on the input tray 13, a duplex copy tray 16, and a sheet bank 17. A sheet is fed from a selected one of the input tray 13, the duplex copy tray 16, and the sheet bank 17. The sheet bearing the toner image is conveyed to the fixing device 27. As specifically illustrated in FIG. 3, the fixing device 27 includes a heating belt 61, a heating source 60 disposed inside the heating belt 61, and a pressure roller 62. The heating belt 61 applies heat to the sheet while the pressure roller 62 applies pressure to the sheet. Thus, the fixing device 27 fixes the toner image onto the sheet under heat and pressure. A detailed description of the fixing device 27 is deferred. After passing through the fixing device 27, the sheet bearing the fixed toner image is ejected onto the output tray 14.

The image forming device 12 includes various sensors such as a first medium-passage sensor 30, a second medium-passage sensor 31, a first temperature sensor 32, a second temperature sensor 33, and a torque sensor 34. The first medium-passage sensor 30 is disposed at an entrance of the fixing device 27 to detect passage of a medium (e.g., sheet). The second medium-passage sensor 31 is disposed at an exit of the fixing device 27 to detect passage of the medium. The first medium-passage sensor 30 and the second medium-passage sensor 31 serve as time measuring devices that measure a transit time of the sheet conveyed by the pressure roller 62 together with the heating belt 61. The first temperature sensor 32 is disposed near the heating belt 61 to measure a surface temperature of the heating belt 61. The second temperature sensor 33 is disposed near the pressure roller 62 to measure a surface temperature of the pressure roller 62. The first temperature sensor 32 and the second temperature sensor 33 serve as temperature measuring devices. The torque sensor 34, serving as a measuring device, measures a driving force (i.e., torque) applied to the pressure roller 62 by a motor 63. The motor 63, serving as a driver, drives the pressure roller 62. The torque sensor 34 also measures the torques of other rotators such as the photoconductive drum 20, the developing roller, the primary transfer roller 25, and the secondary transfer roller 26.

In addition to the sensors described above, the image forming device 12 may include optical sensors that detect an amount of toner adhering to the photoconductive drum 20 and an amount of toner adhering to the intermediate transfer belt 24, a potential sensor that detects a surface potential of the photoconductive drum 20, and a temperature/humidity sensor or an environment sensor that detects, e.g., temperature and humidity inside the image forming apparatus 1.

The control device 140 includes, e.g., a controller 40, a read only memory (ROM) 41, a random access memory (RAM) 42, an interface input/output (I/O) 43, a drive controller 44, a sensor controller 45, a memory 46 such as a hard disk drive (HDD), a memory controller 47, and a communication controller 48.

The controller 40 controls the entire image forming apparatus 1 and executes image processing on the image data output from the scanner 11. The ROM 41 stores a boot program, firmware, and the like. The RAM 42 provides a working area for the controller 40. The interface I/O 43 connects the controller 40 with the operation device 15 and various controllers, such as the drive controller 44, the sensor controller 45, the communication controller 48, a scanner/instruction processing unit (IPU) controller, and a power supply/bias controller, to enable signal exchange therebetween.

The drive controller 44 transmits control signals to drive circuits that drive, e.g., the laser optical system 22, the developing device 23, and the intermediate transfer belt 24, thereby controlling the drive circuits. For example, the drive controller 44 transmits a control signal to a laser optical system driver that drives the laser optical system 22. The sensor controller 45 processes detection signals output from the sensors described above. The sensor controller 45 obtains the ratio of an amount of toner contained in a toner image as a test pattern detected by the optical sensor to an amount of toner contained in a background area. The sensor controller 45 compares the ratio with a reference to detect the fluctuation of image density. Based on the fluctuation, the sensor controller 45 corrects a control value of a toner density sensor for each color.

The memory 46 stores image data, an operating system (OS), application programs for operating the scanner 11, the image forming device 12, and the like. The memory controller 47 controls writing and reading of data to and from the memory 46. The communication controller 48 is connected to a network such as the Internet or Intranet (registered trademark) to control communication via the network.

The operation device 15 includes an input device, such as an input button, and a display. The input device receives operations by, e.g., a user. The display displays, e.g., a processing status for, e.g., a user. The operation device 15 is, e.g., an operation panel having a touch panel aboard.

Figure 2:
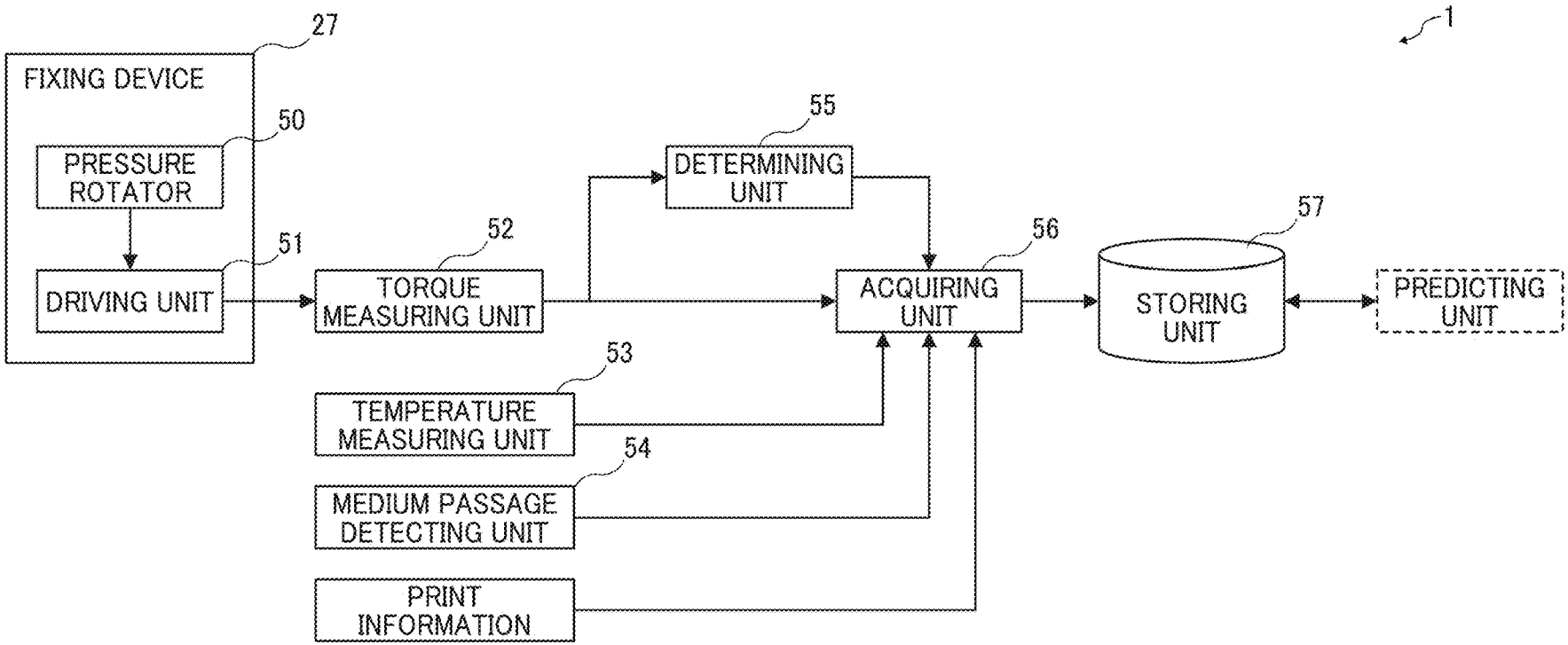
FIG. 2 is a block diagram illustrating a functional configuration of the image forming apparatus according to a first embodiment of the present disclosure.

Referring now to FIG. 2, a description is given of a functional configuration of the image forming apparatus 1 described above.

FIG. 2 is a block diagram illustrating a functional configuration of the image forming apparatus 1 according to a first embodiment of the present disclosure.

The controller 40 retrieves programs from the memory 46 and executes the programs, thereby implementing various functional units illustrated in FIG. 2.

The image forming apparatus 1 includes a pressure rotator 50. The pressure rotator 50 is implemented by, e.g., the pressure roller 62 of the fixing device 27. The image forming apparatus 1 further includes a driving unit 51, a torque measuring unit 52, a temperature measuring unit 53, a medium passage detecting unit 54, a determining unit 55, an acquiring unit 56, and a storing unit 57. Note that the rotator included in the image forming apparatus 1 is not limited to the pressure rotator 50. The temperature measuring unit 53 and the medium passage detecting unit 54 are optional.

The pressure rotator 50 applies pressure to fix toner onto a sheet, serving as a medium, while conveying the sheet in a direction. The driving unit 51 applies a torque to the pressure rotator 50 to rotate the pressure rotator 50 in a given direction. The torque measuring unit 52 measures the torque applied to the pressure rotator 50 by the driving unit 51. The torque thus measured is output, as torque information, to the determining unit 55. The acquiring unit 56 acquires the torque measured. The storing unit 57 stores the torque acquired.

The temperature measuring unit 53 measures a surface temperature of the pressure rotator 50 and a surface temperature of a heater such as the heating belt 61 of the fixing device 27. The medium passage detecting unit 54 detects whether a sheet (i.e., medium) passes through the entrance and the exit of the fixing device 27. The detection result is processed as appropriate. For example, the detection result is converted to a transit time. The temperature measuring unit 53 is implemented by the first temperature sensor 32 and the second temperature sensor 33. The medium passage detecting unit 54 is implemented by the first medium-passage sensor 30 and the second medium-passage sensor 31. That is, the temperature measuring unit 53 and the medium passage detecting unit 54 output sensor information. Note that the medium is not limited to a paper sheet. The medium may be a postcard, an envelope, a plastic sheet, or the like.

According to the torque information output from the torque measuring unit 52, the determining unit 55 determines whether to change at least one of frequency and items of information (i.e., data) to be acquired for prediction of a defective conveyance of a sheet, such as a paper j am, caused by a malfunction of the pressure rotator 50. The determining unit 55 may determine to change the items alone. Alternatively, the determining unit 55 may determine to change the frequency alone. Alternatively, the determining unit 55 may determine to change both the items and the frequency. Alternatively, the determining unit 55 may determine to change neither. Note that the defective conveyance of a sheet is hereinafter described as a paper j am.

The acquiring unit 56 acquires data of at least one of the items according to a result of determination made by the determining unit 55, at a frequency according to the result of determination. Then, the acquiring unit 56 stores the data thus acquired in the storing unit 57. For example, when the determining unit 55 determines to change the items alone, the acquiring unit 56 acquires data of at least one of the items determined, at substantially the same frequency as a frequency before determination. Examples of data to be acquired for prediction of a paper jam include sensor information, torque information, and print information upon printing on a sheet (i.e., medium) such as a sheet type, a sheet thickness, a sheet size, and a linear speed.

A predicting unit reads the data from the storing unit 57 to predict a paper j am. In the present example, the predicting unit is implemented by another device such as a computer, a server, or the like. Alternatively, the predicting unit may be implemented by the image forming apparatus 1.

As described above, according to the present embodiment, the image forming apparatus 1 changes at least one of frequency and items of data to be acquired. Accordingly, the image forming apparatus 1 acquires a reduced amount of data at an appropriate time.

As described above, the rotator in the image forming apparatus 1 is not limited to the pressure rotator 50 that is implemented by, e.g., the pressure roller 62.

Figure 3:
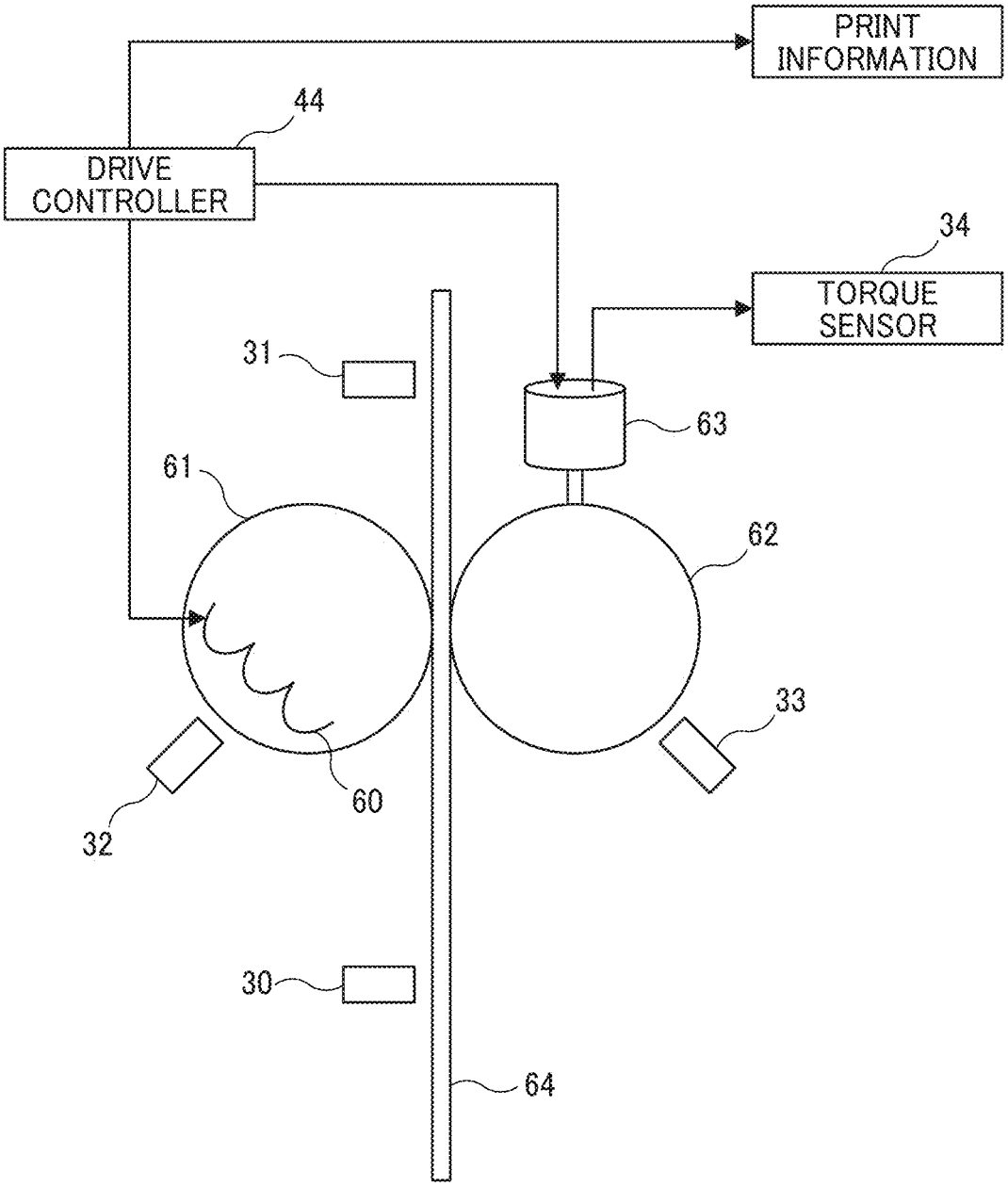
FIG. 3 is a schematic view of a fixing device incorporated in the image forming apparatus.

Since the rotator is herein described as the pressure rotator 50, a description is now given of a configuration of the fixing device 27 that includes the pressure rotator 50 with reference to FIG. 3.

FIG. 3 is a schematic view of the fixing device 27 incorporated in the image forming apparatus 1.

As described above, the fixing device 27 includes the heating belt 61, the heating source 60 disposed inside the heating belt 61, the pressure roller 62, and the motor 63 that applies a torque to the pressure roller 62 to rotate the pressure roller 62. As described above, the pressure roller 62 implements the pressure rotator 50. The heating belt 61 and the pressure roller 62 are disposed adjacent to each other. A sheet 64, serving as a medium, is conveyed between the heating belt 61 and the pressure roller 62.

The pressure roller 62 rotates in a given direction by the torque applied by the motor 63. The heating belt 61 rotates in conjunction with the rotation of the pressure roller 62. When the sheet 64 is conveyed in, from one side, between the pressure roller 62 and the heating belt 61 both rotating, the sheet 64 is sandwiched by the pressure roller 62 and the heating belt 61 and pulled in the pressure roller 62 and the heating belt 61 as the pressure roller 62 and the heating belt 61 rotate. Thus, the pressure roller 62 conveys the sheet 64 together with the heating belt 61. Then, the sheet 64 is ejected from another side.

The drive controller 44 inputs control signals to the heating source 60 and the motor 63. According to the control signal received, the heating source 60 causes the heating belt 61 to reach a given temperature. The control signal input to the motor 63 controls the number of rotations of the motor 63. In addition to the control signals, the drive controller 44 outputs the print information.

The first medium-passage sensor 30 and the second medium-passage sensor 31 are disposed at the entrance and the exit of the fixing device 27, respectively. The sheet 64 is conveyed into the fixing device 27 from a leading end of the sheet 64. The first medium-passage sensor 30 detects that the leading end and a trailing end of the sheet 64 reach the entrance of the fixing device 27. The second medium-passage sensor 31 detects that the leading end and the trailing end of the sheet 64 reach the exit of the fixing device 27. The detection results are processed as appropriate. For example, the transit time of the sheet 64 is calculated from the detection results.

The first temperature sensor 32 is disposed near the heating belt 61 to measure the surface temperature of the heating belt 61. On the other hand, the second temperature sensor 33 is disposed near the pressure roller 62 to measure the surface temperature of the pressure roller 62. The torque sensor 34 is attached to the motor 63 to measure the torque applied by the motor 63 to the pressure roller 62.

Figure 4:
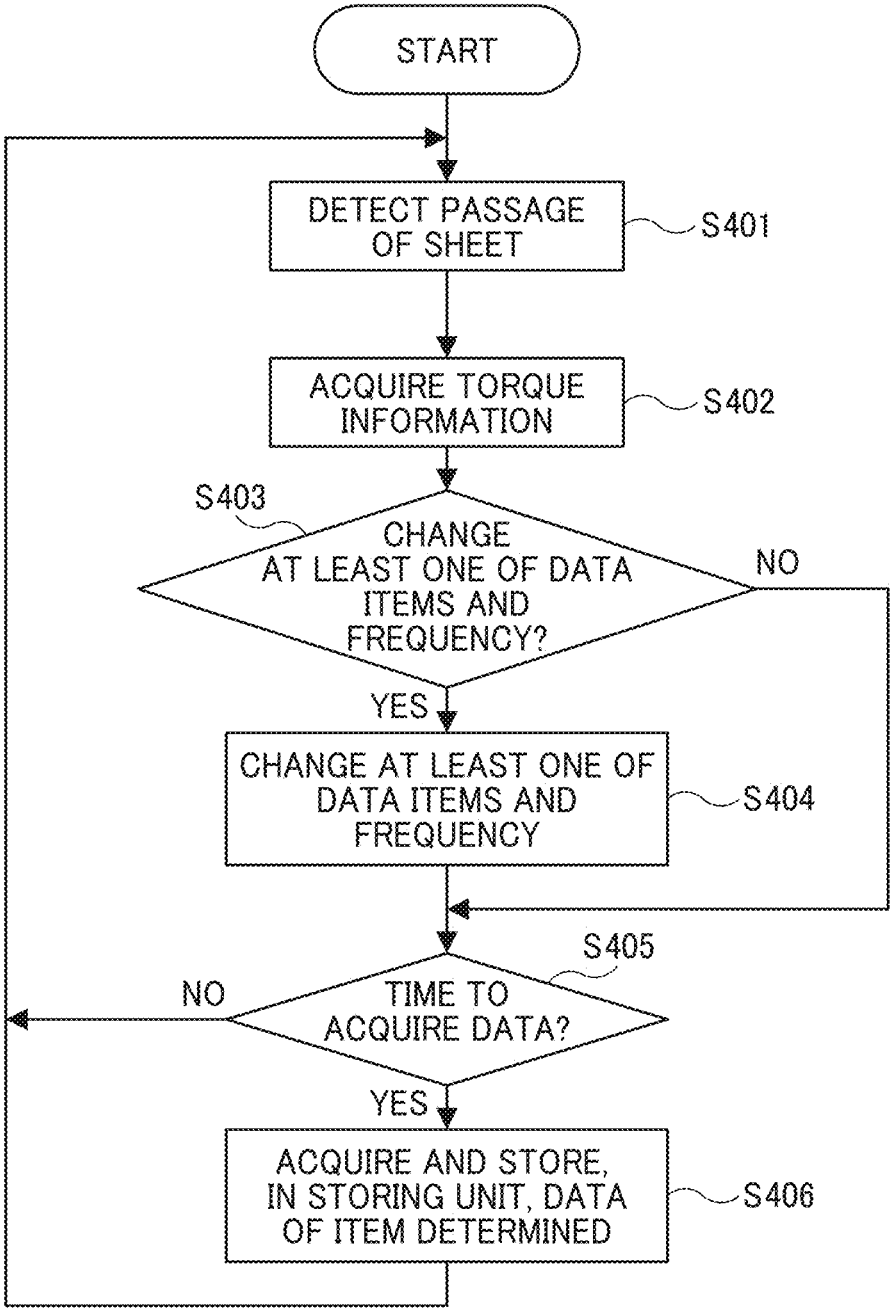
FIG. 4 is a flowchart illustrating an overall process executed by the image forming apparatus.

Referring now to FIG. 4, a description is given of an overall process executed by the image forming apparatus 1.

FIG. 4 is a flowchart illustrating an overall process executed by the image forming apparatus 1.

In step S401, the medium passage detecting unit 54 detects passage of a sheet 64. In step S402, the torque measuring unit 52 measures a torque and acquires torque information. The torque measuring unit 52 acquires the torque information upon passage of each sheet 64. Meanwhile, the temperature measuring unit 53 acquires temperature information upon passage of each sheet 64. The temperature information is an example of the sensor information.

In step S403, the determining unit 55 determines whether to change at least one of the frequency and the items of data to be acquired, according to the torque information acquired. When the determining unit 55 determines to change either or both of the frequency and the data items (YES in step S403), at least one of the frequency and the items of data to be acquired is changed in step S404. Then, the process proceeds to step S405. On the other hand, when the determining unit 55 determines to change neither of the frequency and the data items (NO in step S403), the process proceeds directly to step S405.

In step S405, based on the frequency determined, the determining unit 55 determines whether the time to acquire data has been reached. When the determining unit 55 determines that the time to acquire data has not been reached (NO in step S405), the process returns to step S401, in which the medium passage detecting unit 54 detects passage of a next sheet 64. On the other hand, the determining unit 55 determines that the time to acquire data has been reached (YES in step S405), the process proceeds to step S406.

In step S406, the acquiring unit 56 acquires data of the item selected or determined. Then, the acquiring unit 56 stores the data in the storing unit 57. Thereafter, the process returns to step S401.

Figure 5:
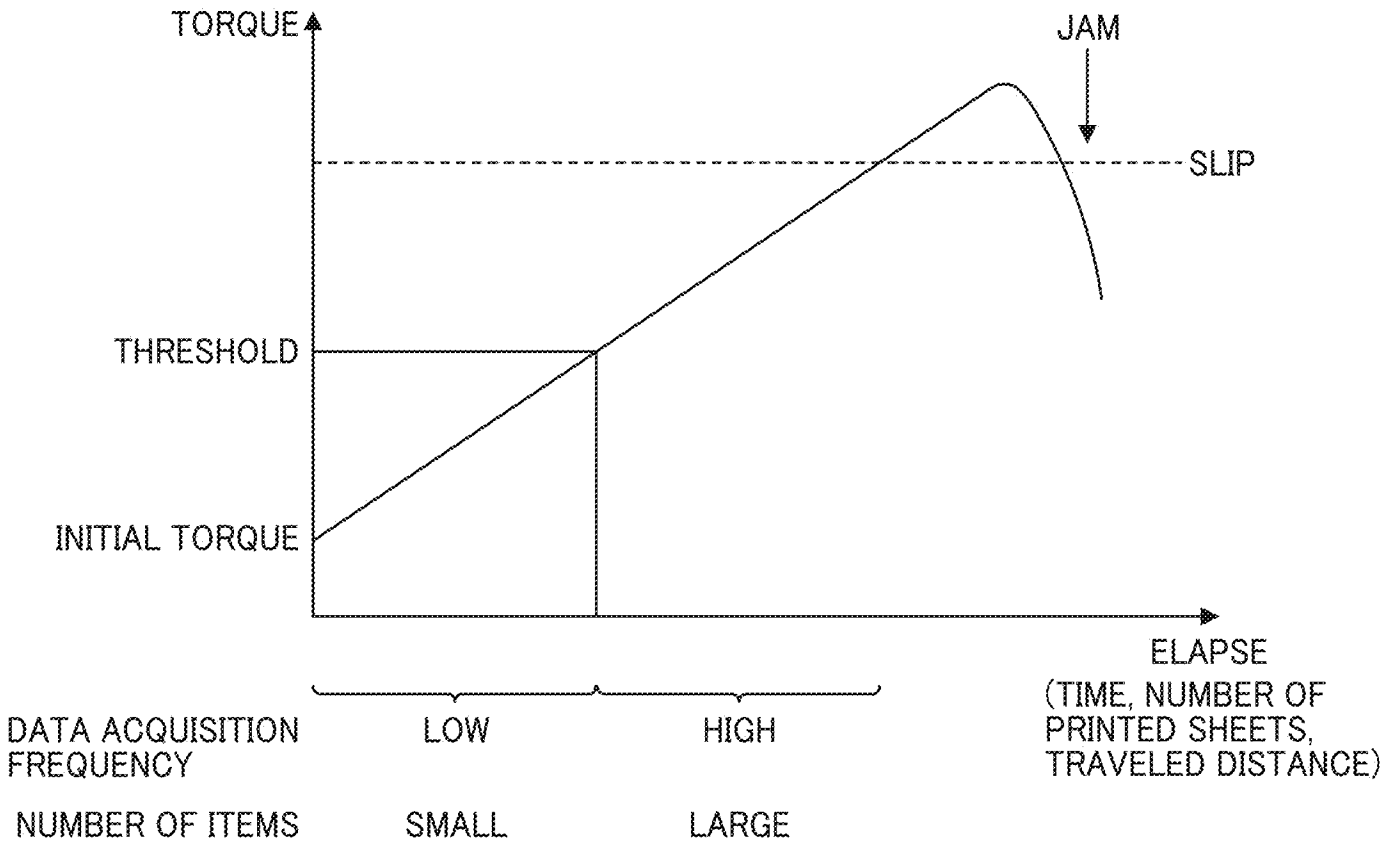
FIG. 5 is a graph illustrating a relationship between torque and elapse.

Referring now to FIG. 5, a description is given of a criterion of the torque information for determination as to whether to change at least one of the frequency and the items of data to be acquired.

FIG. 5 is a graph illustrating a relationship between torque and elapse.

As an example, the following describes a criterion of the torque information according to which the determining unit 55 determines to change both of the frequency and the data items. Alternatively, the determining unit 55 determines to change the items alone, or the frequency alone.

In FIG. 5, the horizontal axis represents elapse (time, number of printed sheets, traveled distance). The vertical axis represents torque. The torque increases substantially in proportion to the elapse (i.e., passage of time, increase in number of printed sheets and traveled distance). As the torque reaches a given level indicated by a broken line, a slip occurs. The torque continues to rise for a while, and then drops, causing a paper jam. FIG. 5 illustrates an example of timing of occurrence of the slip and paper jam. The slip and the paper jam may occur at the same time.

Thus, occurrence of a paper jam is predicted from changes in torque acquired. Specifically, a slip and a paper jam are predicted to occur when the torque reaches a given level.

A paper jam may not occur in an image forming apparatus that is on operation for a relatively short period of time and has printed a relatively small number of sheets with the photoconductive drum running a relatively short distance. Therefore, the torque information is acquired at a low frequency. On the other hand, the possibility of a paper jam is relatively high in an image forming apparatus that is on operation for a certain period of time and has printed a certain number of sheets with the photoconductive drum running a certain distance. In such a case, acquisition of data of more items at a higher frequency is desired to enhance prediction accuracy.

According to the present embodiment, in order to change the frequency and the items of data to be acquired with delimiting the range, a threshold of torque (hereinafter simply referred to as a threshold) is provided as a criterion for determination as to whether to change at least one of the frequency and the items. Accordingly, the image forming apparatus 1 changes at least one of the frequency and the items of data to be acquired, depending on, e.g., whether the torque is equal to or greater than the threshold or whether an elapsed time is equal to or longer than a time corresponding to the threshold.

In a case in which the torque is less than the threshold or in a case in which the elapsed time is less than the time corresponding to the threshold, the image forming apparatus 1 reduces either or both of the items of data to be acquired and the frequency of acquiring the data. On the other hand, in a case in which the torque is not less than the threshold or in a case in which the elapsed time is not less than the time corresponding to the threshold, the image forming apparatus 1 increases either or both of the items of data to be acquired and the frequency of acquiring the data.

As the threshold, an average torque value (i.e., driving force value) in an arbitrary or given section or a torque value at a given time or timing is adoptable.

Figure 6:
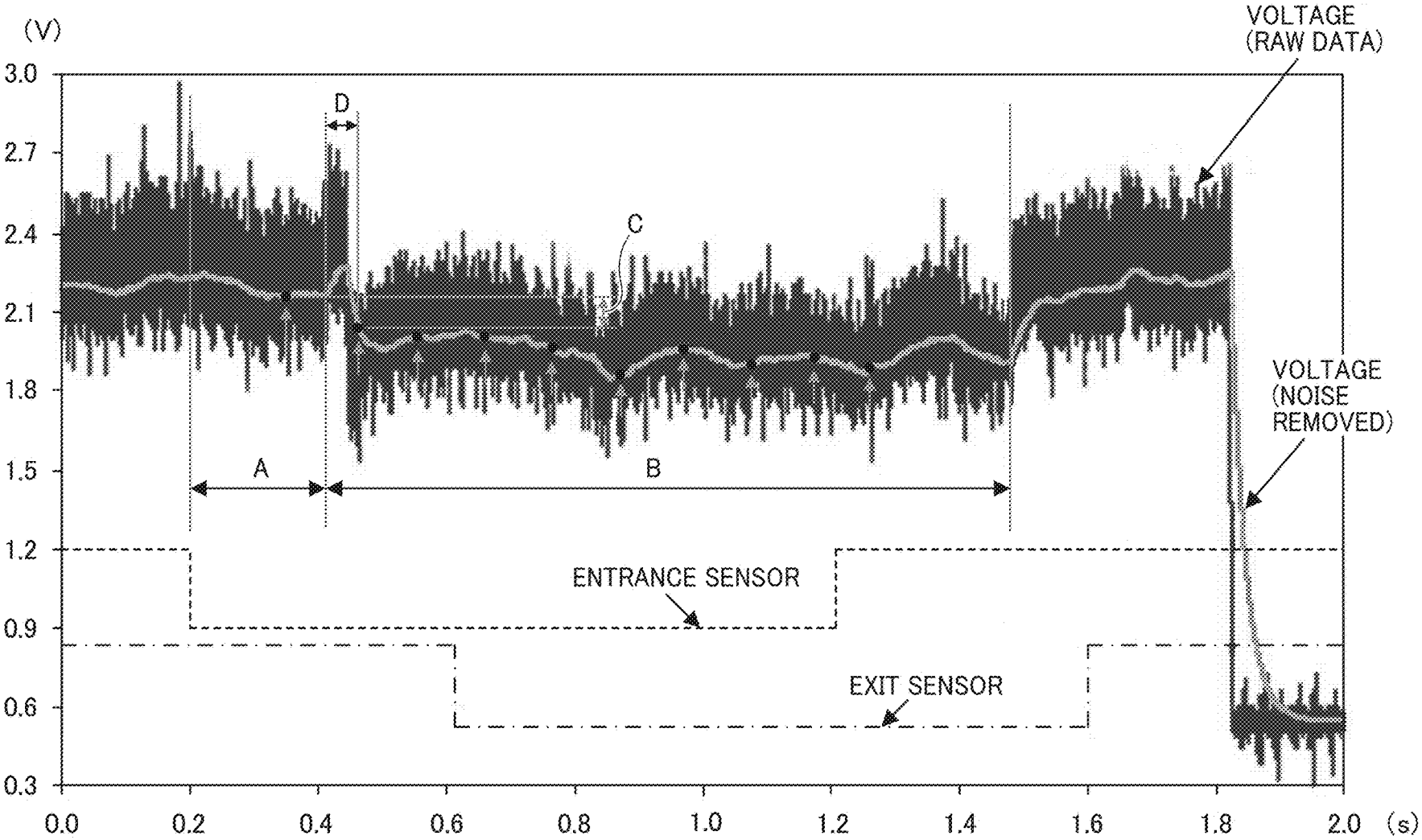
FIG. 6 is a graph illustrating a relationship between elapsed time and voltage.

Referring now to FIG. 6, a description is given of the section.

FIG. 6 is a graph illustrating a relationship between the elapsed time (sec.) and the voltage (V) input for applying a torque to the pressure roller 62.

Although the voltage (V) is herein used, the current (A) may be used alternatively. In FIG. 6, the two waveforms are a waveform of a raw torque (voltage) and a voltage waveform after noise is removed with a noise removal filter. The rectangular wave indicated by a broken line indicates a signal from an entrance sensor (i.e., first medium-passage sensor 30) disposed at the entrance of the fixing device 27. On the other hand, the rectangular wave indicated by a long dashed short dashed line indicates a signal from an exit sensor (i.e., The second medium-passage sensor 31) disposed at the exit of the fixing device 27. The sensor signals are examples of the sensor information. A signal level is "low" when the sheet 64 is detected; whereas the signal level is "high" when the sheet 64 is not detected.

Examples of the arbitrary or given section include Section A, Section B, Section C, and Section D. An example of the given timing is indicated as dots pointed by arrows in FIG. 6. The section may be a section of torque or a section of time (i.e., period of time). Section A indicates a section of time before the sheet 64 is conveyed in between the heating belt 61 and the pressure roller 62. Section B indicates a section of time from the time when the sheet 64 is conveyed in between the heating belt 61 and the pressure roller 62 until when the sheet 64 is ejected therefrom. Section C indicates a section of torque, which is a difference between a torque before the sheet 64 is conveyed in between the heating belt 61 and the pressure roller 62 and a torque after the sheet 64 is conveyed therein. The section D is a shock section in which the voltage exhibits a large fluctuation as the sheet 64 is conveyed in between the heating belt 61 and the pressure roller 62. The data in Section D is excludable. Note that the shock section also exists when the sheet 64 is ejected from between the heating belt 61 and the pressure roller 62.

The average torque value is calculated from data of a plurality of points. The data of the plurality of points is, e.g., periodic data at regular time intervals as indicated by black dots in Section B. Examples of the data of a point include an average value, a minimum value, a maximum value, or a standard deviation value of data in a certain section including the point.

The torque value at the given timing can be data of an arbitrary point. For example, the torque value may be data indicated by a black dot in Section A. Examples of the data of the arbitrary point include an average value, a minimum value, a maximum value, or a standard deviation value of data in a certain section including the point.

Referring now to FIG. 7, a description is given of the frequency and the data items subject to change according to the criterion for determination.

FIG. 7 is a table illustrating an example of items and frequencies changeable based on the threshold.

According to the example illustrated in FIG. 7, in a case in which the torque is less than the threshold, the torque information and the sensor information are determined as items of data to be acquired for each 100 sheets. That is, the frequency is determined as once per 100 sheets. On the other hand, in a case in which the torque is equal to or greater than the threshold, data of all items are determined to be acquired for each 50 sheets. In this case, the frequency is determined as once per 50 sheets.

The torque information may be either or both of a voltage value (or a current value) used for controlling the torque and a pulse width modulation (PWM), which is a pulse width of a pulse signal, indicating a control signal value. Alternatively, the torque information may be either or both of torque values into which the voltage value (or the current value) and the PWM (i.e., control signal value) are converted. Similar to the threshold described above, an average torque value in an arbitrary or given section or a torque value at a given time or timing is adoptable as the torque information. As the torque increases with time-related deterioration, use of such torque information allows appropriate prediction of a paper jam.

The frequencies are intervals at which the data is acquired (i.e., sampling intervals). Examples of the frequencies include the number of the sheets 64 passing through the fixing device 27. The number of the sheets 64 can be any number provided that a relation of $K \geq J$ is satisfied, where K represents the number of sheets when the torque value is less than the threshold and J represents the number of sheets when the torque value is equal to or greater than the threshold. Each of K and J is an integer of 1 or more.

For example, when the frequency of acquiring data is determined as each K-number of sheets, the data may be acquired upon passage of each Kth sheet. Alternatively, the data may be acquired upon passage of a first or second sheet of a print job during passage of the K-number of sheets. Alternatively, the data may be acquired upon passage of each Kth sheet and upon passage of the first or second sheet of each print job.

The frequency may be an arbitrary number of sheets or the timing when certain conditions are satisfied. Examples of the timing for acquiring data include each time when a certain condition is satisfied and a certain time, of all times, when the certain condition is satisfied.

The sensor information is data of, e.g., a sheet transit time and temperatures. The sheet transit time is calculated from the detection results of the first medium-passage sensor 30 and the second medium-passage sensor 31. The temperatures are measured by the first temperature sensor 32 and the second temperature sensor 33. A combination of such data and the torque information enhances accuracy of determination as to whether to change at least one of the frequency and data items. This is because the sheet transit time and the temperature change over time like the torque.

Examples of the print information include the sheet type indicating the type of the sheet 64, the sheet thickness indicating the thickness of the sheet 64, the sheet size indicating the size of the sheet 64, the linear speed indicating the speed of conveying the sheet 64, the number of printed sheets 64, and monochrome/color information. Examples of the data to be acquired include the print information because occurrence of a slip depends on, e.g., the sheet type.

"The number of times the torque reaches or exceeds the threshold" is the number of times the torque acquired at the sampling intervals reaches or exceeds the threshold, as one of information of a result of determination. As the number of times increases, the probability of a paper jam increases. Therefore, by acquiring the number of times, the image forming apparatus 1 acquires a reduced amount of data.

FIG. 7 illustrates the torque information and the sensor information as the items of data to be acquired when the torque is less than the threshold. Alternatively, the torque information and either of the print information and "the number of times the torque reaches or exceeds the threshold" may be acquired when the torque is less than the threshold. Alternatively, the torque information and two of the other three pieces of information, namely, the sensor information, the print information, and "the number of times the torque reaches or exceeds the threshold" may be acquired when the torque is less than the threshold.

Figure 8:
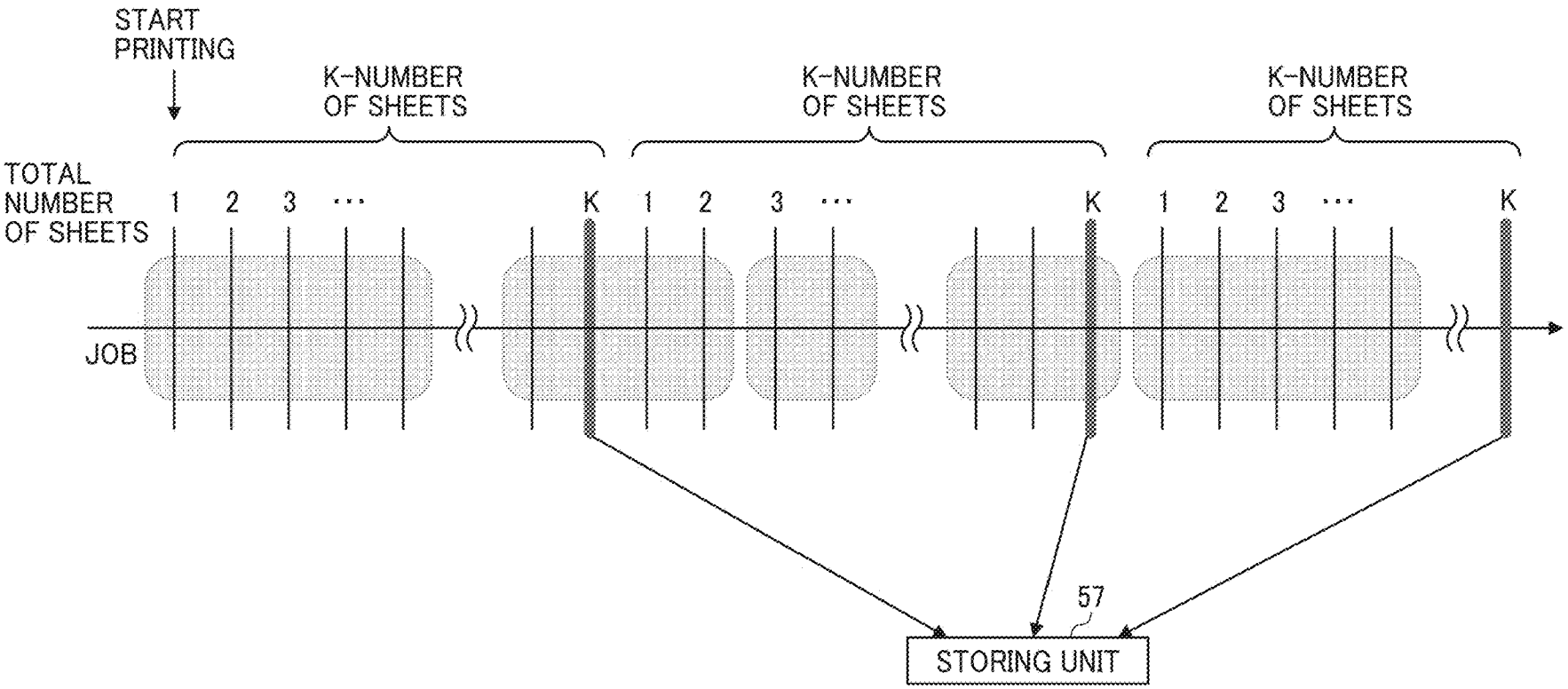
FIG. 8 is a diagram illustrating a first example of data acquisition.

Referring now to FIG. 8, a description is given of a first example of data acquisition.

FIG. 8 is a diagram illustrating the first example of data acquisition.

According to the first example, the data is acquired for each K-number of sheets. Specifically, the data is acquired and stored in the storing unit 57 upon passage of each Kth sheet 64.

Note that the passage of a sheet 64 is defined by the second medium-passage sensor 31 detecting the trailing end of the sheet 64 bearing a toner image at the exit of the fixing device 27. A substantially rectangular shape indicates a period during which one print job is executed. The timing of passage of the sheets 64 is indicated by vertical lines provided at equal intervals so as to cut the substantially rectangular shape.

In the example illustrated in FIG. 8, the data is acquired and stored in the storing unit 57 upon passage of the Kth sheet 64, regardless of the print jobs. Examples of the data acquired include the torque information, such as the voltage value and the PWM, and the sensor information. In FIG. 8, the torque information, the sensor information, and the print information are acquired as data and stored in the storing unit 57.

A sheet 64 passing after the Kth sheet 64 is counted as the first sheet 64. When the following Kth sheet 64 passes, the data is acquired and stored in the storing unit 57 again. Thus, the data is acquired and stored in the storing unit 57 upon passage of each Kth sheet 64. The frequency has been described as each K-number of sheets for the case in which the torque is less than the threshold. When the torque is not less than the threshold, the data is acquired for each J-number of sheets. This also applies to the examples described below.

Figure 9:
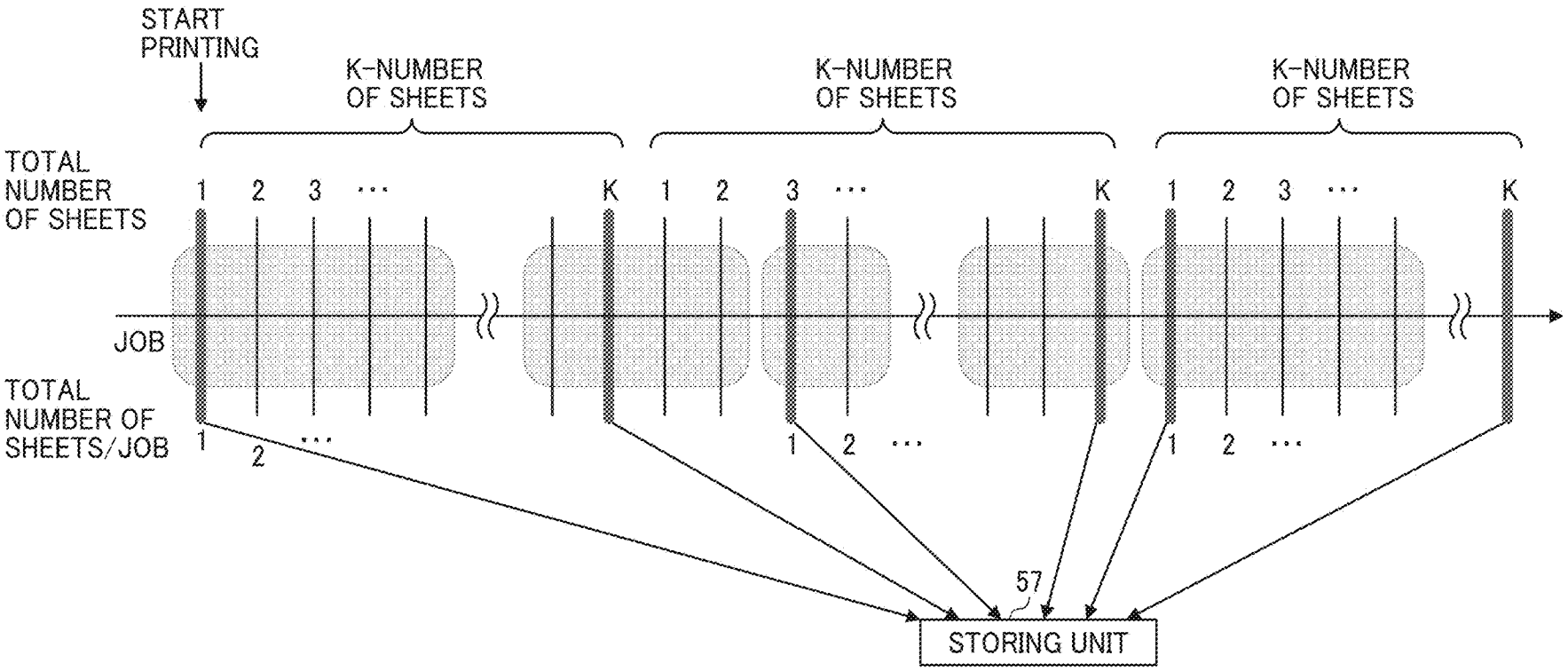
FIG. 9 is a diagram illustrating a second example of data acquisition.

Referring now to FIG. 9, a description is given of a second example of data acquisition.

FIG. 9 is a diagram illustrating the second example of data acquisition.

According to the second example, the data is acquired for each K-number of sheets.

Specifically, the data is acquired and stored in the storing unit 57 upon passage of each Kth sheet 64 and upon passage of the first or second sheet 64 of a print job during passage of the K-number of sheets 64.

In the present example, the data is acquired upon passage of the first sheet 64 of each print job.

Specifically, the data is acquired and stored in the storing unit 57 upon passage of the first sheet 64 of a print job during passage of the K-number of sheets 64 and upon passage of the Kth sheet 64.

Figure 10:
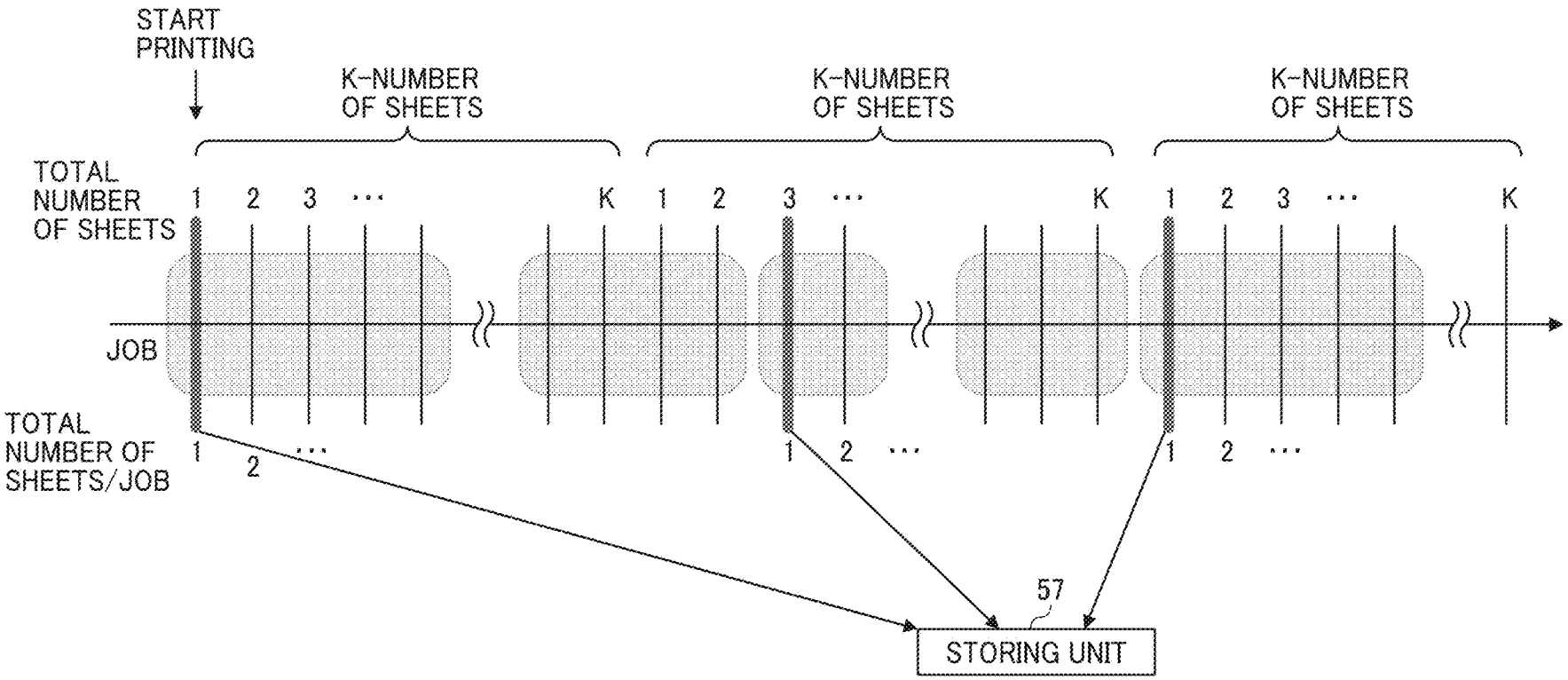
FIG. 10 is a diagram illustrating a third example of data acquisition.

Referring now to FIG. 10, a description is given of a third example of data acquisition.

FIG. 10 is a diagram illustrating the third example of data acquisition.

According to the third example, the data is acquired for each K-number of sheets. Specifically, the data is acquired and stored in the storing unit 57 upon passage of the first or second sheet 64 of a print job during passage of the K-number of sheets 64.

In the present example, the data is acquired upon passage of the first sheet 64 of each print job.

Specifically, the data is acquired and stored in the storing unit 57 upon passage of the first sheet 64 of a print job during passage of the K-number of sheets 64. Note that a first sheet of a print job is the first sheet of a first print job in a unit of K-number of sheets when the K-number of sheets is counted from first.

The torque measured by the torque sensor 34 varies due to changes in temperature. The most stable temperature is measured upon passage of the first sheet of a print job. That is, the data acquired upon passage of the first sheet of a print job, as illustrated in FIGS. 9 and 10, is the optimum data for prediction of a paper jam.

Note that the data may be acquired during a print job or during an adjustment operation that is performed between print jobs.

Figure 11:
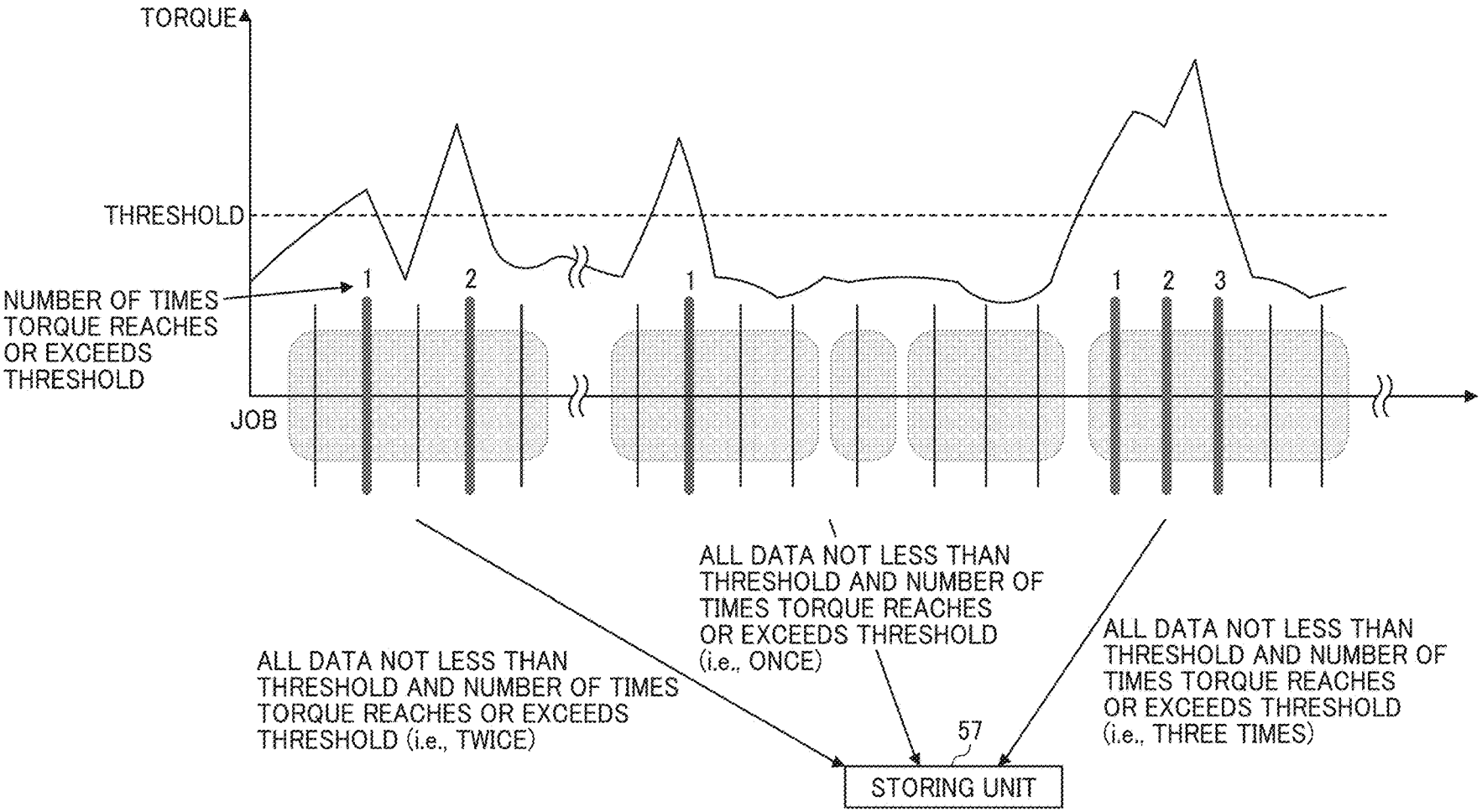
FIG. 11 is a diagram illustrating a fourth example of data acquisition.

Referring now to FIG. 11, a description is given of a fourth example of data acquisition.

FIG. 11 is a diagram illustrating the fourth example of data acquisition.

According to the fourth example, the data is acquired and stored in the storing unit 57 each time when a certain condition is satisfied.

The certain condition may be any condition. In the present example, the data is acquired and stored in the storing unit 57 each time when the torque reaches or exceeds the threshold.

In FIG. 11, the horizontal axis represents the elapsed time of print jobs. The vertical axis represents the torque. Specifically, the determining unit 55 determines, upon passage of each sheet 64, whether the torque is equal to or greater than the threshold. When the determining unit 55 determines that the torque is equal to or greater than the threshold, the acquiring unit 56 acquires data and stores the data in the storing unit 57. Examples of the data include the torque information, the sensor information, the print information, and "the number of times the torque reaches or exceeds the threshold". "The number of times the torque reaches or exceeds the threshold" is a counted number for each print job.

Figure 12:
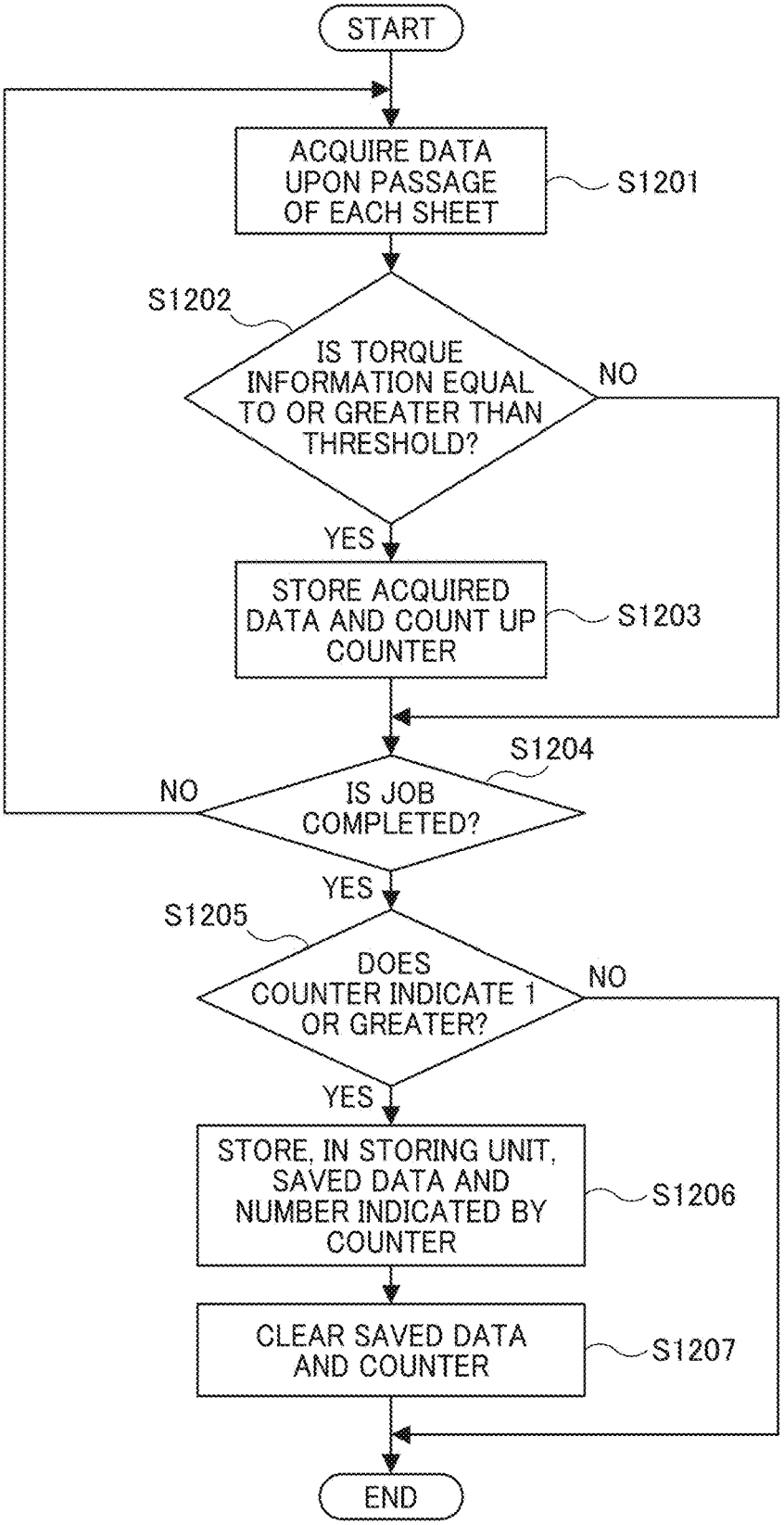
FIG. 12 is a flowchart illustrating a flow of a process for acquiring information according to the fourth example.

Referring now to FIG. 12, a description is given of a flow of a process for acquiring information according to the fourth example illustrated in FIG. 11.

FIG. 12 is a flowchart illustrating a flow of the process for acquiring information according to the fourth example.

In step S1201, the data is acquired upon passage of each sheet 64. Specifically, each time when one sheet 64 passes through the fixing device 27, the acquiring unit 56 acquires the data such as the torque information.

In step S1202, the determining unit 55 determines whether the torque information (i.e., torque) is equal to or greater than the threshold.

When the determining unit 55 determines that the torque information is equal to or greater than the threshold (YES in step S1202), the process proceeds to step S1203 to temporarily save the acquired data and count up a counter of the number of times the torque reaches or exceeds the threshold. Then, the process proceeds to step S1204.

On the other hand, when the determining unit 55 determines that the torque information is less than the threshold (NO in step S1202), the process proceeds directly to step S1204.

In step 1204, the determining unit 55 determines whether a print job is completed. When the print job is in process (NO in step S1204), the process returns to step S1201. On the other hand, when the print job is completed (YES in step S1204), the process proceeds to step S1205.

In step S1205, the determining unit 55 determines whether the counter of the number of times the torque reaches or exceeds the threshold indicates 1 or greater.

When the determining unit 55 determines that the counter indicates 1 or greater (YES in step S1205), the process proceeds to step S1206 to store, in the storing unit 57, the temporarily saved data and the number indicated by the counter.

Then, in step S1207, the data stored in a temporarily saving area is cleared. The counter is also cleared to 0.

Thus, the process for one print job is completed.

On the other hand, when the counter indicates 0 (NO in step S1205), the process ends.

In order to acquire a reduced amount of data, for example, the following combination is adoptable. In a case of a combination of the torque information and "the number of times the torque reaches or exceeds the threshold", raw torque information is acquired upon passage of a first sheet 64 when the torque firstly reaches or exceeds the threshold during continuous conveyance of the sheets 64 in a print job. Thereafter, in the print job, the number of times the torque reaches or exceeds the threshold is counted alone. This is an example of acquiring a part of data pieces that satisfy the certain condition described above. In other words, the data is acquired at a certain time, of all times, when the certain condition is satisfied.

Figure 13:
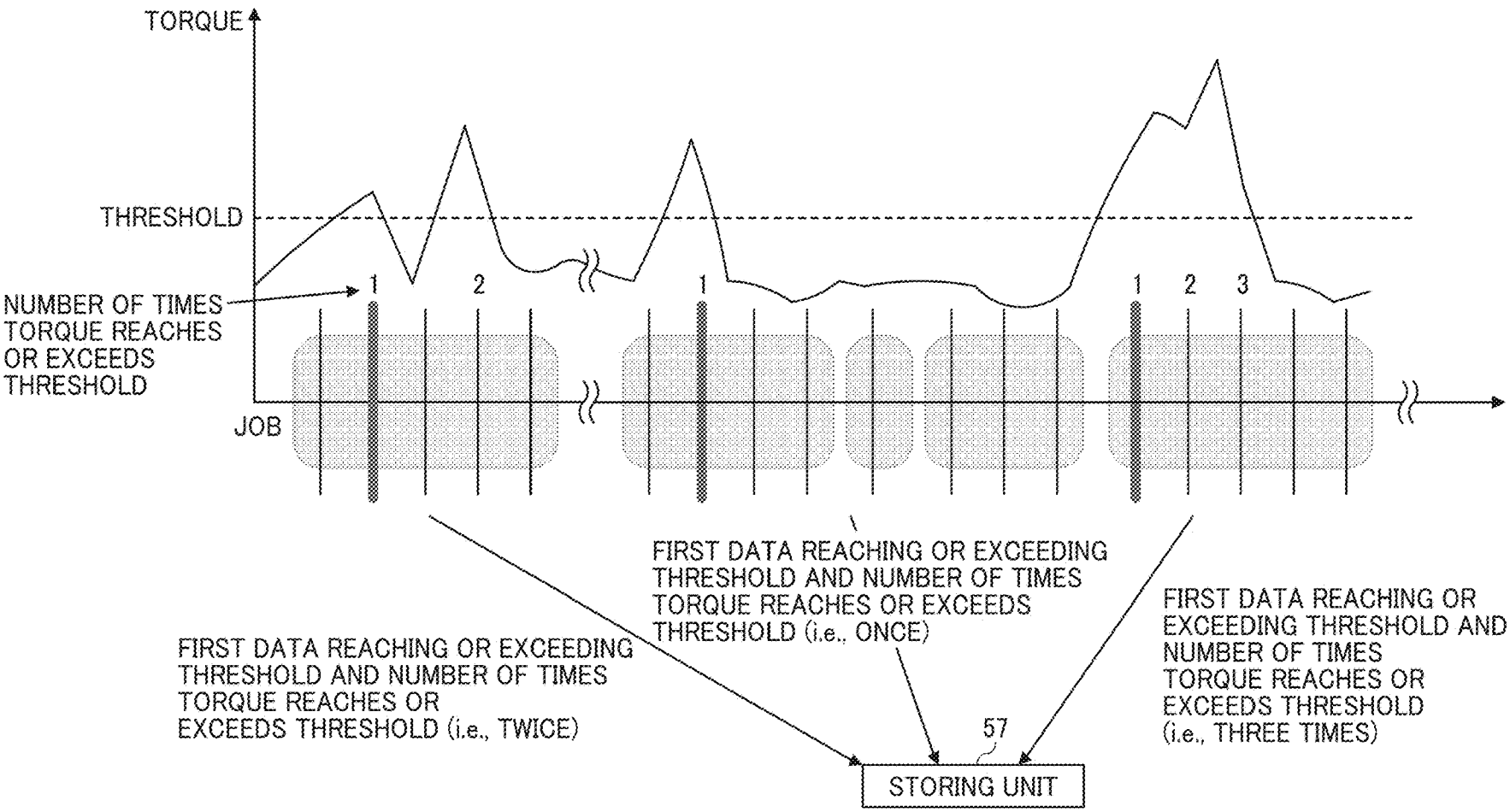
FIG. 13 is a diagram illustrating a fifth example of data acquisition.

Referring now to FIG. 13, a description is given of the example of acquiring a part of data described above, as a fifth example of data acquisition.

FIG. 13 is a diagram illustrating the fifth example of data acquisition.

The torque information, the sensor information, the print information, and "the number of times the torque reaches or exceeds the threshold" are acquired upon passage of the first sheet 64 when the torque firstly reaches or exceeds the threshold for each print job. Upon passage of the second and subsequent sheets 64 when the torque reaches or exceeds the threshold, a count value is acquired alone. The count value is a counted number of times when the torque reaches or exceeds the threshold. FIG. 13 illustrates five print jobs. The number of times the torque reaches or exceeds the threshold is "twice" in the first print job. The number of times the torque reaches or exceeds the threshold is "once" in the second print job. The number of times the torque reaches or exceeds the threshold is "zero" in the third and fourth print jobs. The number of times the torque reaches or exceeds the threshold is "three times" in the fifth print job.

That is, when the torque firstly reaches or exceeds the threshold in the first print job, the torque information, the sensor information, the print information, and the number information (i.e., once) are acquired. When the torque secondly reaches or exceeds the threshold in the first print job, the number information (i.e., twice) is acquired alone. Similarly, since the number of times the torque reaches or exceeds the threshold is "once" in the second print job, the torque information, the sensor information, the print information, and the number information (i.e., once) are acquired when the torque reaches or exceeds the threshold in the second print job.

Since the number of times the torque reaches or exceeds the threshold is "zero" in the third and fourth print jobs, the data such as the torque information is not acquired. Similar to the cases of the first and second print jobs, since the number of times the torque reaches or exceeds the threshold is "three times" in the fifth print job, the torque information, the sensor information, the print information, and the number information (i.e., once) are acquired when the torque firstly reaches or exceeds the threshold in the fifth print job. When the torque secondly reaches or exceeds the threshold in the fifth print job, the number information (i.e., twice) is acquired like in the case of the first print job. Similarly, when the torque thirdly reaches or exceeds the threshold in the fifth print job, the number information (i.e., three times) is acquired.

Figure 14:
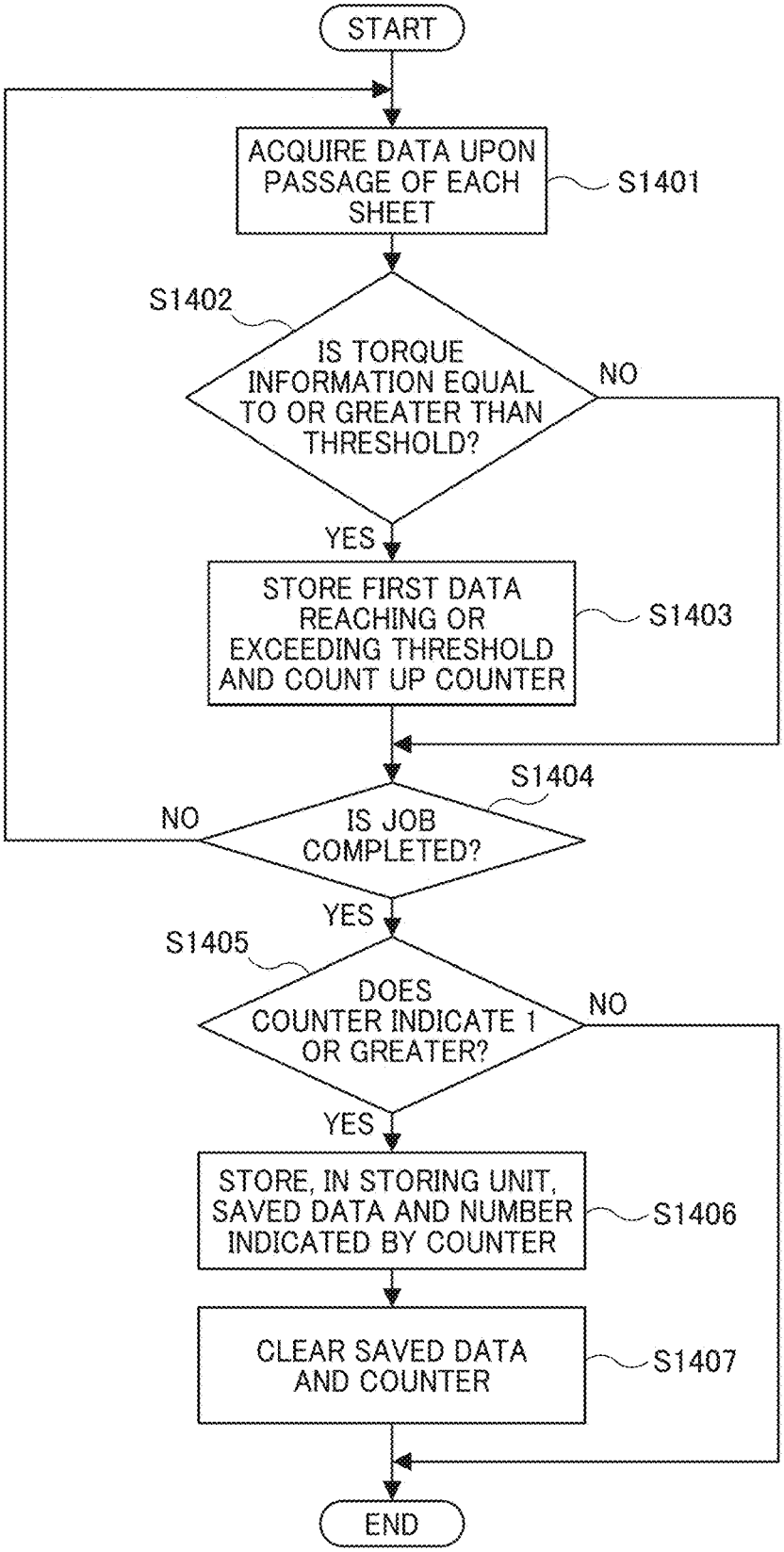
FIG. 14 is a flowchart illustrating a flow of a process for acquiring information according to the fifth example.

Referring now to FIG. 14, a description is given of a flow of a process for acquiring information according to the fifth example illustrated in FIG. 13.

FIG. 14 is a flowchart illustrating a flow of the process for acquiring information according to the fifth example.

In step S1401, the data is acquired upon passage of each sheet 64. Specifically, each time when one sheet 64 passes through the fixing device 27, the acquiring unit 56 acquires the data such as the torque information.

In step S1402, the determining unit 55 determines whether the torque value included in the torque information is equal to or greater than the threshold.

When the determining unit 55 determines that the torque value is equal to or greater than the threshold (YES in step S1402), the process proceeds to step S1403 to temporarily save the data acquired upon passage of the first sheet 64 when the torque value firstly reaches or exceeds the threshold (i.e., first data reaching or exceeding the threshold) and count up a counter of the number of times the torque value reaches or exceeds the threshold. Then, the process proceeds to step S1404.

On the other hand, when the determining unit 55 determines that the torque value is less than the threshold (NO in step S1402), the process proceeds directly to step S1404.

In step S1404, the determining unit 55 determines whether a print job is completed. When the print job is in process (NO in step S1404), the process returns to step S1401. On the other hand, when the print job is completed (YES in step S1404), the process proceeds to step S1405.

In step S1405, the determining unit 55 determines whether the counter of the number of times the torque value reaches or exceeds the threshold indicates 1 or greater.

When the determining unit 55 determines that the counter indicates 1 or greater (YES in step S1405), the process proceeds to step S1406 to store, in the storing unit 57, the temporarily saved data and the number indicated by the counter.

Then, in step S1407, the data stored in the temporarily saving area is cleared. The counter is also cleared to 0.

Thus, the process for one print job is completed.

On the other hand, when the counter indicates 0 (NO in step S1405), the process ends.

A description has been given of examples of determination, according to the torque information, as to whether to change the frequency and the items of data to be acquired. The determination may be made according to the torque information alone, or according to a combination of the torque information and one or more of the sensor information, the print information, and the like.

Figure 15:
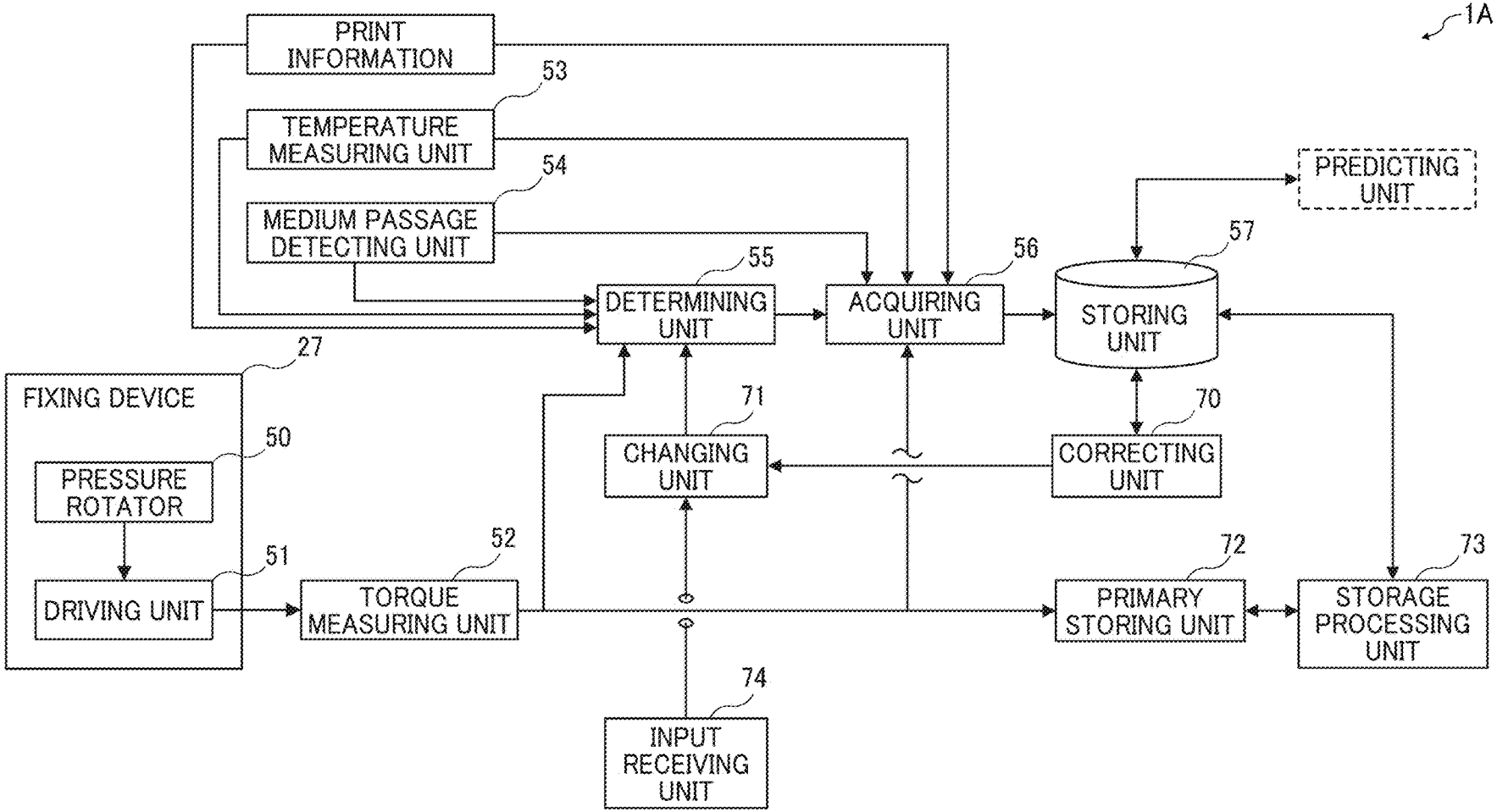
FIG. 15 is a block diagram illustrating a functional configuration of an image forming apparatus according to a second embodiment of the present disclosure.

Referring now to FIG. 15, a description is given of a functional configuration of an image forming apparatus that determines whether to change the frequency and the items of data to be acquired, according to the combination of the torque information and one or more of the sensor information, the print information, and the like.

FIG. 15 is a block diagram illustrating a functional configuration of an image forming apparatus 1A according to a second embodiment of the present disclosure.

Similar to the image forming apparatus 1 of FIG. 2, the image forming apparatus 1A of FIG. 15 includes the pressure rotator 50, the driving unit 51, the torque measuring unit 52, the temperature measuring unit 53, the medium passage detecting unit 54, the determining unit 55, the acquiring unit 56, and the storing unit 57. The image forming apparatus 1A further includes a correcting unit 70, a changing unit 71, a primary storing unit 72, a storage processing unit 73, and an input receiving unit 74. Since a detailed description has been given of the pressure rotator 50, the driving unit 51, the torque measuring unit 52, the temperature measuring unit 53, the medium passage detecting unit 54, the determining unit 55, the acquiring unit 56, and the storing unit 57, a detailed description is now given of the correcting unit 70, the changing unit 71, the primary storing unit 72, the storage processing unit 73, and the input receiving unit 74.

The input receiving unit 74 receives a threshold change command from, e.g., a user. The threshold change command includes an instruction to change a threshold and a new threshold value. The input receiving unit 74 notifies the changing unit 71 of the threshold change command. According to the instruction included in the threshold change command, the changing unit 71 changes the threshold, which is used by the determining unit 55 for determination, to the new threshold value.

The threshold is not limited to one. Alternatively, the threshold may include a plurality of threshold values. Such a plurality of threshold values allows finer adjustment of the data amount. In addition, the threshold is settable for each model and identity of image forming apparatuses. Thus, a paper jam is predictable as appropriate for each model and identity, taking into consideration variations among the models and among the identities that identify individual image forming apparatuses.

The correcting unit 70 corrects the threshold based on data stored in the storing unit 57. For example, when the torque frequently reaches or exceeds the threshold because a relatively small threshold is set, the correcting unit 70 increases the threshold value. At this time, when the elapsed time, the number of printed sheets, and the traveled distance are sufficiently small, the correcting unit 70 may correct the threshold to be greater than the largest torque value of the torque values exceeding the set threshold. The correction of the threshold is not limited to the example described above.

The correcting unit 70 instructs the changing unit 71 to change the threshold to the corrected threshold value. Upon receiving the instruction, the changing unit 71 changes the threshold to the threshold value corrected by the correcting unit 70.

In addition, when the data to be acquired is changed due to the threshold change, the correcting unit 70 corrects the data stored in the storing unit 57. For example, when the stored data becomes unnecessary due to the threshold change, the correcting unit 70 deletes the unnecessary data. When correction is desired, for example, when a part of data pieces becomes unnecessary, the correcting unit 70 corrects the data pieces, thus changing the data pieces. Note that the correcting unit 70 does nothing when correction is unnecessary.

The primary storing unit 72, as a driving force memory, stores torque information acquired or measured by the torque measuring unit 52. As described above, an average torque value in an arbitrary or given section or a torque value at a given time or timing is adoptable as the torque information.

The storage processing unit 73 calculates a feature quantity, representing a feature of a torque value, from the torque information stored in the primary storing unit 72. The storage processing unit 73 deletes the torque information stored in the storing unit 57 and stores the feature quantity thus calculated. In short, the storage processing unit 73 replaces the torque information with the feature quantity. In the present example, the storing unit 57 serves as a secondary storing unit.

Examples of the feature quantity include an average torque value, a minimum torque value, a maximum torque value, a standard torque deviation, and a periodic torque component. The periodic torque component is, e.g., the PWM. Storing the feature quantity obviates the need to store the torque information one by one, thereby reducing the data amount to be stored.

A computer-readable recording medium storing a program code according to the embodiments described above is providable. Alternatively, e.g., a server device may be providable that stores the program code and provides the program code upon a download request.

According to the embodiments of the present disclosure, an image forming apparatus acquires a reduced amount of information for prediction of a defective conveyance of a medium by a rotator.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from that described above.

Any of the above-described devices or units can be implemented as a hardware apparatus, such as a special-purpose circuit or device, or as a hardware/software combination, such as a processor executing a software program.

Further, each of the functions of the described embodiments may be implemented by one or more processing circuits or circuitry. Processing circuitry includes a programmed processor, as a processor includes circuitry. A processing circuit also includes devices such as an application-specific integrated circuit (ASIC), digital signal processor (DSP), field programmable gate array (FPGA) and conventional circuit components arranged to perform the recited functions.

Further, as described above, any one of the above-described and other methods of the present disclosure may be embodied in the form of a computer program stored on any kind of storage medium. Examples of storage media include, but are not limited to, floppy disks, hard disks, optical discs, magneto-optical discs, magnetic tapes, nonvolatile memory cards, read only memories (ROMs), etc.

Alternatively, any one of the above-described and other methods of the present disclosure may be implemented by the ASIC, prepared by interconnecting an appropriate network of conventional component circuits or by a combination thereof with one or more conventional general-purpose microprocessors and/or signal processors programmed accordingly.

What is claimed is:

1. A conveying apparatus comprising:

a rotator configured to convey a medium;

a driver configured to apply a driving force to the rotator to rotate the rotator;

a measuring device configured to measure the driving force applied to the rotator by the driver; and circuitry configured to:

determine, according to the driving force measured, whether to change at least one of frequency and items of information to be acquired for prediction of a defective conveyance of the medium caused by the rotator; and acquire information of at least one of the items according to a result of determination, at a frequency according to the result of determination.

2. The conveying apparatus according to claim 1, wherein the measuring device is configured to measure, as the driving force, at least one of a voltage value, a current value, a control signal value, and driving force values into which the voltage value, the current value, and the control signal value are converted, and wherein the voltage value, the current value, and the control signal value are values of a voltage, a current, and a control signal applied to the driver, respectively.

3. The conveying apparatus according to claim 1, wherein the circuitry is configured to acquire, as the information of at least one of the items, information of the driving force and at least one of information of the result of determination and information of the medium.

4. The conveying apparatus according to claim 1, further comprising at least one of a time measuring device configured to measure a transit time of the medium conveyed by the rotator and a temperature measuring device configured to measure a surface temperature of the rotator, wherein the circuitry is configured to determine whether to change the at least one of frequency and items according to the driving force measured and at least one of the transit time measured and the surface temperature measured.

5. The conveying apparatus according to claim 4, wherein the circuitry is configured to acquire, as the information of at least one of the items, information of the driving force and at least one of information of the result of determination, information of the medium, information of the transit time, and information of the surface temperature.

6. The conveying apparatus according to claim 1, further comprising a memory configured to store the information of at least one of the items acquired at the frequency according to the result of determination.

7. The conveying apparatus according to claim 6, further comprising a driving force memory configured to store information of the driving force measured, wherein the circuitry is further configured to:

calculate a feature quantity from the information of the driving force stored in the driving force memory; and replace, with the feature quantity, the information of the driving force included in the information of at least one of the items stored in the memory, and wherein the feature quantity represents a feature of the information of the driving force.

8. The conveying apparatus according to claim 1, wherein the circuitry is further configured to change a criterion for determination as to whether to change the at least one of frequency and items.

9. The conveying apparatus according to claim 8, wherein the circuitry is further configured to perform correction on the information acquired, based on the criterion for determination changed, and wherein the correction includes one of a change and a deletion.

10. The conveying apparatus according to claim 8, wherein the circuitry is configured to change the criterion for determination based on at least one of a model of the conveying apparatus and an identity of the conveying apparatus.

11. The conveying apparatus according to claim 1, wherein the circuitry is configured to determine whether to change the at least one of frequency and items according to at least one of an average of driving force values measured for a given period of time, a driving force value measured at a given time, and a driving force value measured within the given period of time.

12. A method for acquiring information in a conveying apparatus, the conveying apparatus including a rotator and a driver, the method comprising:

measuring a driving force applied to the rotator by the driver;

determining, according to the driving force measured, whether to change at least one of frequency and items of information to be acquired for prediction of a defective conveyance of a medium caused by the rotator; and acquiring information of at least one of the items according to the determining, at a frequency according to the determining.

13. A non-transitory, computer-readable recording medium storing computer-readable program code that causes a computer to perform a method for acquiring information in a conveying apparatus, the conveying apparatus including a rotator and a driver, the method comprising:

measuring a driving force applied to the rotator by the driver;

determining, according to the driving force measured, whether to change at least one of frequency and items of information to be acquired for prediction of a defective conveyance of a medium caused by the rotator; and acquiring information of at least one of the items according to the determining, at a frequency according to the determining.

* * * * *